US008034320B2

(12) United States Patent
Rundel

(10) Patent No.: US 8,034,320 B2
(45) Date of Patent: Oct. 11, 2011

(54) MICROWAVE TREATMENT OF MAGNETITE IRON ORE PELLETS TO CONVERT MAGNETITE TO HEMATITE

(75) Inventor: Paul Frank Rundel, Ocean Reef (AU)

(73) Assignee: Ore Pro PTY Ltd., Campbell Town, New South Whales ( * ) Notice: Subject to any disclaimer, the term of this patent is extended or adjusted under 35 U.S.C. 154(b) by 184 days.

(21) Appl. No.: 12/372,016

(22) Filed: Feb. 17, 2009

(65) Prior Publication Data

US 2009/0202406 A1 Aug. 13, 2009

Related U.S. Application Data

(63) Continuation of application No. PCT/AU2007/001200, filed on Aug. 22, 2007.

(30) Foreign Application Priority Data

Aug. 28, 2006 (AU) ..... 2006904659

(51) Int. Cl.
*C01G 49/00* (2006.01)

(52) U.S. Cl. ..... 423/632; 423/633; 423/634

(58) Field of Classification Search ..... 423/632–634
See application file for complete search history.

(56) References Cited

U.S. PATENT DOCUMENTS

| | | | | |
|---|---|---|---|---|
| 3,261,959 | A | 7/1966 | Connel et al. | |
| 5,376,162 | A | 12/1994 | Cavanagh | |
| 5,972,302 | A * | 10/1999 | Tranquilla et al. | 423/148 |
| 7,479,288 | B2 * | 1/2009 | Sauer et al. | 424/647 |

FOREIGN PATENT DOCUMENTS

| | | |
|---|---|---|
| JP | 09-176750 A | 7/1997 |
| WO | 03/102250 | 12/2003 |

OTHER PUBLICATIONS

International Search Report for International Application PCT/AU2007/001200.

Cigdem Cirpar, "Heat Treatment of Iron Ore Agglomerates with Microwave Energy", Masters Thesis submitted to Middle East Technical University, Jan. 2005, pp. 1-90.

* cited by examiner

*Primary Examiner* — Steven Bos

(74) *Attorney, Agent, or Firm* — Edell, Shapiro & Finnan, LLC

(57) ABSTRACT

A method and apparatus for producing iron ore pellets containing hematite is described. The pellets containing magnetite are exposed to microwave energy in a heat treatment furnace under oxidizing conditions to convert magnetite to hematite.

24 Claims, 3 Drawing Sheets

MICROWAVE TREATMENT OF MAGNETITE IRON ORE PELLETS TO CONVERT MAGNETITE TO HEMATITE

CROSS REFERENCE TO RELATED APPLICATIONS

This application is a continuation of PCT/AU02007/001200, filed Aug. 22, 2007, and titled "The Treatment of Green Pellets Using Microwave Energy," which claims priority to Australian Application No. AU 2006904659, filed on Aug. 28, 2006, the entire contents of which are hereby incorporated by reference.

FIELD OF THE INVENTION

The present invention relates to the treatment of green pellets containing iron using microwave energy to effect the transformation of magnetite to hematite.

The present invention relates particularly, though not exclusively, to the use of microwave energy to heat green pellets containing iron using microwave energy to facilitate subsequent processing of an ore to recover iron.

BACKGROUND TO THE INVENTION

World iron ore production consists primarily of hematite ($Fe_2O_3$) with simple open cut operations producing easily mineable and directly saleable products of lump and fines with iron content >63% Fe. Magnetite ($Fe_3O_4$) is also a readily available iron source but due to its low in-situ Fe values (30-40% Fe), requires additional upgrading to produce a marketable product.

WO 03/102250 describes the use of microwave energy to treat ores to facilitate subsequent processing of the ores to recover valuable components such as metals from the ores. The microwave energy caused some form of structural alteration of the ore particles without significantly altering the mineralogy, i.e. composition, of the ore. The structural alteration occurred as the result of differences in thermal expansion of minerals within ore particles, as a consequence of exposure to microwave energy, resulting in regions of high stress/strain within the ore particles and leading to microcracking or other physical changes within the ore particles. The micro-cracks improved leachability and susceptibility to subsequent comminution to reduce the particle size of the particles.

SUMMARY OF THE INVENTION

Using the method of the present invention, microwave energy is used to provide heating to green pellets containing iron to transform magnetite to hematite in a more controllable manner than by heating the pellets using gas-fired heaters or oil burners. Moreover the heating caused using microwave energy is essentially instantaneous, greatly reducing processing time and operating costs when compared with the use of conventional rotary kilns, shaft furnaces and grate kilns. The present invention is further based on the recognition that ensuring that continuous air flow occurs through the rotary kiln facilitates a more complete oxidation of the magnetite ores.

According to one aspect of the present invention there is provided a method for producing iron ore pellets containing hematite by exposing pellets containing magnetite to microwave energy in a heat treatment furnace under oxidizing conditions to convert magnetite to hematite.

In one form, the green pellets contain at least 60-80% magnetite prior to exposure of the green pellets to microwave energy. The green pellets may have a major dimension of less than 15 mm prior to exposure of the green pellets to microwave energy or have a major dimension greater than 6 mm and less than 15 mm prior to exposure of the green pellets to microwave energy.

The risk of plasma production is reduced when the method further comprises the step of screening the green pellets prior to exposing the green pellets to microwave energy to remove fines. Advantageously, the fines removed during the step of screening may be recycled to form a portion of the magnetite concentrate fed to the pelletizing apparatus.

In one form, the method further comprises the step of transporting the green pellets to an inlet end of the heat treatment apparatus on a conveyer and transporting the microwave-treated pellets from an outlet end of the heat treatment apparatus on a conveyer.

In one form, the green pellets are produced in a pelletizing apparatus, the feed to the pelletizing apparatus comprising a liquid, preferably water, and a magnetite concentrate. For best results, more than fifty percent of the particles in the magnetite concentrate fed to the pelletizing apparatus are less than 63 microns in size.

In one form, the feed to the pelletizing apparatus further comprises a binder and the binder is added to the feed to the pelletizing apparatus at a dosage rate of 3, 5 or 10 times the normal dosage rate of 0.3-15 kg per tonne.

In one form, the method further comprises the step of drying the green pellets prior to the step of exposing the green pellets to microwave energy in the heat treatment apparatus and the step of drying may include heating the green pellets to a temperature less than 300 degree Celsius using microwave energy to drive off moisture.

In one form, microwave energy is used to heat the green pellets in the heat treatment apparatus to a temperature in the range of 300-1300° C. Preferably, the heat treatment apparatus includes a microwave co-operatively coupled with a waveguide for controlling the distribution of the microwaves into the heat treatment apparatus. When the heat treatment apparatus has a feed end and a discharge end, the method may include the step of supplying microwave energy into either the feed end or the discharge end of the heat treatment apparatus via waveguides. Alternatively, the method may include the step of supplying microwave energy into both the feed end and the discharge end of the heat treatment apparatus simultaneously via waveguides.

In one form, microwave energy is supplied to an oxidation zone via a first waveguide and microwave energy is supplied to a curing zone via a second waveguide and the level of microwave energy supplied to the curing zone is different from the level of microwave energy supplied to the oxidation zone. Oxidation may be enhanced within the oxidation zone of the heat treatment apparatus using air or oxygen enrichment, for example, by injecting supplementary air into the heat treatment apparatus using a lance.

In one form, the green pellets are porous. Porosity is encouraged in one embodiment by adding coarse particles into the magnetite concentrate feed upstream of the pelletizing apparatus. Preferably, the magnetite concentrate feed comprises coarse particles in the range of 3 to 10% of the total magnetite concentrate feed.

In one form, the method further comprises the step of curing the pellets after oxidation of the magnetite to hematite, preferably at a temperature in the range of 1200-1300° C.

In one form, the method further comprises the step of cooling the pellets downstream of the heat treatment apparatus and using the hot gases produced as a result of cooling the pellets to pre-heat or dry the green pellets upstream of the heat treatment apparatus.

According to a second aspect of the present invention there is provided an apparatus for producing iron ore pellets containing hematite by exposing pellets containing magnetite to microwave energy in a heat treatment furnace under oxidizing conditions to convert magnetite to hematite.

In one form, the apparatus further comprises a screening apparatus for screening the green pellets to remove fines prior to exposing the green pellets to microwave energy in the heat treatment furnace. In another form, the apparatus further comprises a first conveyor for transporting the green pellets to an inlet end of the heat treatment apparatus and a second conveyor for transporting the microwave-treated pellets from an outlet end of the heat treatment apparatus.

In one form, the apparatus further comprises a drying apparatus for drying the green pellets prior to the step of exposing the green pellets to microwave energy in the heat treatment apparatus. In another form, the heat treatment apparatus includes a microwave co-operatively coupled with a waveguide for controlling the distribution of the microwaves into the heat treatment apparatus.

When the heat treatment apparatus has a feed end and a discharge end, the method may includes the step of supplying microwave energy into either the feed end or the discharge end of the heat treatment apparatus via waveguides or may include the step of supplying microwave energy into both the feed end and the discharge end of the heat treatment apparatus simultaneously via waveguides.

In one form, microwave energy is supplied to an oxidation zone via a first waveguide and microwave energy is supplied to a curing zone via a second waveguide and the level of microwave energy supplied to the curing zone is different from the level of microwave energy supplied to the oxidation zone. To enhance oxidation, the apparatus may further comprise a lance for directing supplemental air or oxygen within the oxidation zone of the heat treatment apparatus.

According to a third aspect of the present invention there is provided an iron ore pellet producing using the method of the first aspect of the present invention or the apparatus of the second aspect of the present invention.

BRIEF DESCRIPTION OF THE DRAWINGS

In order to facilitate a more detailed understanding of the nature of the invention several embodiments will now be described in detail, by way of example only, with reference to the accompanying drawings, in which.

DETAILED DESCRIPTION OF PREFERRED EMBODIMENTS

Preferred embodiments of the present invention are now described. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. Throughout this specification the term "pelletizing" is used to refer to a process whereby fine powders or concentrates are formed into larger conglomerates, typically using water and one or more binding agents. For specific applications, fluxes may also be added.

The term "induration" is used to describe high temperature bonding of particles within the agglomerated pellets. The terms implies the bonding together of particles of minerals by solid state mechanisms as contrasted with the term "sintering" which implies that liquid phase bonding occurs.

The term "microwave" is used to cover the portion of the electromagnetic spectrum between 300 MHz and 300 GHz which corresponds to wavelengths ranging from 1 m to 1 mm.

An embodiment of an apparatus 10 for producing iron ore pellets is now described with reference to FIG. 1. A magnetite concentrate containing typically ~70% iron is fed into a pelletizing apparatus 12 along with a liquid, preferably water, to form "green pellets". For best results, the moisture content of the green pellets should be in the range of 8-15% as excessive moisture contributes to larger, poor quality green pellets due to weakening of capillary forces. The magnetite concentrate fed to the pelletizing apparatus 12 may contain iron in the form of magnetite or iron in both magnetite and hematite form, depending on the particular iron-containing ore being processed.

Figure 2:
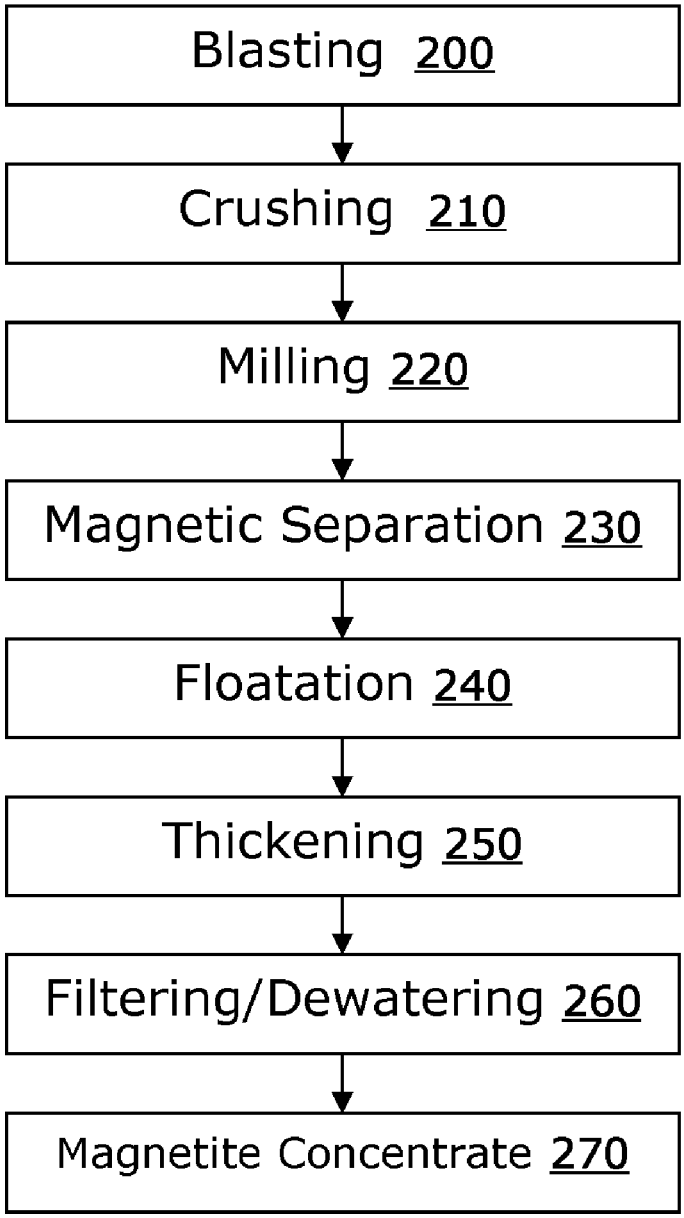
FIG. 2 is a process flow diagram illustrating a conventional mining method for producing a magnetite concentrate.

The magnetite concentrate provided as a feed to the pelletizing apparatus 12 may be produced using any suitable process. In the process flow chart of FIG. 2, the magnetite concentrate is produced by subjecting a magnetite bearing ore to conventional mining methods (either open-cut or underground). The ore is subjected to blasting (step 200), crushing (step 210) and milling (step 220) followed by conventional beneficiation processes (step 230), in this example, wet, low-intensity magnetic separation, followed by flotation (step 240) and then concentrate thickening (step 250). After thickening, the magnetite concentrate is filtered and de-watered (step 260), producing a moist magnetite concentrate product (step 270) containing 8-15% moisture. The magnetite concentrate fed to the pelletizing apparatus may equally be sourced from tailings.

The specific type of pelletizing apparatus 12 is not critical to the working of the present invention, although preferred types of pelletizing apparatus include balling drums, pelletizing drums, discs or cones.

When a pelletizing drum is used as the pelletizing apparatus 12, it is fitted internally with mesh onto which the magnetite concentrate feed is fed adheres. The mesh is used to reduce internal slippage and provide a rough texture to serve as an initiation point for ball formation. When the pelletizing drum rotates, this generates a rolling and balling effect that causes the green pellets to form on and adhere to the mesh. The thickness of the layer that builds up on the mesh is controlled using an internally fitted reciprocating cutter bar which continually breaks off green pellets when the layer builds up to a predetermined size.

When a pelletizing disc is used as the pelletizing apparatus, the pelletizing disc includes one or more rotating large diameter, flat-bottomed pans or discs which are steeply inclined, typically around 45 to 55 degrees to the horizontal. The feed to the pelletizing apparatus is held within the rotating disc until balls of a predetermined size are formed. A pelletizing disc requires more headroom but less floor space than a pelletizing drum for an equivalent duty.

The size of the particles in the magnetite concentrate fed to the pelletizing apparatus 12 has a direct effect on the size and strength of the green pellets produced. For optimum pellet production, it is preferable that more than fifty percent of the particles in the magnetite concentrate are less than 63 microns in size. The majority of magnetite concentrates produced using convention mining and beneficiation methods typically comprise particles having a size well below 63 microns due to the fine grinding required for the liberation of gauge components ($SiO_2$, S, P, Ca, etc) in some ores.

Concentrate particle sizing is directly proportional to the required pellet specifications with regards acceptable gangue minerals.

Two types of iron ore pellets are produced, namely "BF Pellets" which are suitable for blast furnace feed and "DRI Pellets" which are suitable as a feed to a direct reduction iron furnace feed. Typically, the $SiO_2$ content of the DRI pellets must be below 1% which in most instances requires a very fine grind (approximately 80%-35 microns). In contrast, blast furnaces are more tolerant, allowing a $SiO_2$ content of less than 5.5% for BF Pellets. When the green pellets being produced are intended to meet the typical specification requirements of BF Pellets, the particles of the magnetite concentrate can be produced using a more favourable coarser grind.

In addition to the liquid and the magnetite concentrate fed to the pelletizing apparatus 12, one or more binders is be added if required. Binders are added to increase green pellet strength as well as assist in pellet plasticity during screening, transportation and movement of the green pellets as they move from the pelletizing apparatus 12 to a downstream drying apparatus 16. Binders also assist in retention of dry pellet strength after drying. Binders can be broken down into four general types, namely, soluble salts, bentonite, inorganic binders, and organic binders (either natural or synthetic). Binder selection is in part determined by whether BF or DRI pellets are being produced. Commercially available high grade bentonite typically contains between 20-65% $SiO_2$. Bentonite is thus the preferred binder for BF pellet production. Examples of suitable binders include CARBOCEL (also referred to as Carbocel), such as Carbocel 3V (manufactured by Lamberti), ALCOTAC (manufactured by Ciba-Geigy) or PERIDUR (manufactured by Akzo Nobel). Bentonite addition rates vary dependant on the particle size of the magnetite concentrate feed and on the grade of bentonite, with bentonite addition rates generally being between 5-15 kg/tonne.

Organic binders are used in the more selective DRI pellet market where reduced $SiO_2$ is considered beneficial. Organic binders, although more expensive, combust during the heating/induration process thereby producing a more porous pellet which assists in pellet oxidation, reduction in pellet impurities ($SiO_2$, S, P) and improves reduction properties during the downstream steel making process. Similarly, organic binder dosage rates also vary depending on concentrate grade and required pellet specifications, with commercial addition rates approximately 1/10 of conventional high-grade bentonite dosage rates i.e. 0.03-0.1% or 0.3-1 kg per tonne.

Pellets produced with binder addition only, are termed "acid" pellets and are used to counteract the basicity of sintered fines charge to blast furnaces. In addition to binders, one or more fluxes may be added to the magnetite concentrate to produce so-called "basic" pellets. Basic pellets are used primarily in DRI furnaces to assist in both the formation of slag and preservation of refractory life. Examples of suitable fluxes include calcium hydroxide, dolomite, and limestone.

Downstream of the pelletizing apparatus 12 is a screening apparatus 14 which is used to control the size of the green pellets that are fed to a drying apparatus 16 for the next stage of the process. The preferred size of the green pellets fed to the drying apparatus 16 is in the range of 6-15 mm. The screening apparatus 14 is used to remove fines which are recycled to form a portion of the magnetite concentrate fed to the pelletizing apparatus 12. Any suitable screening apparatus may be used, for example one or more trommels, vibratory screens or independent roller screens arranged in series or parallel. For best results, it is preferable that the green pellets be subjected to minimal handling between the pelletizing apparatus 12 and the drying apparatus (described below) to minimise the risk of the green pellet breakage and excessive fines production. In order to facilitate a more even distribution of the green pellets on to the sizing screens 14, the pelletizing apparatus or drum 12 is provided with a discharge chute 18, preferably arranged in a spiral configuration to distribute the green pellets more evenly and gently over the screens of the screening apparatus 14.

Drying of the screened green pellets in the drying apparatus 16 is conducted at moderate temperatures, ranging from ambient to 300° C. to facilitate in moisture removal. Drying is best conducted using a gradual increase in temperature so as to obviate the risk of pellet cracking, "core and shell" phenomena (excessively rapid drying) or general weakening of pellet structure. The present invention is based in part on a realisation that the heat transfer rates experienced during drying and induration influences the final pellet quality and strength. It is important to control the heat transfer rate to ensure that the pellets are not weakened by structural cracking. Without wishing to be bound by theory, if the green pellets are dried too rapidly, excessive evaporation/displacement of moisture will increase pellet deformation i.e. cracking, splitting and rupture. The drying stage typically has a residence time of 2-15 minutes depending on the capacity and type of drying apparatus used, the moisture content of the green pellets and pellet composition. The drying apparatus 16 can be any suitable heating device, for example a rotary kiln, a fixed-bed or fluidized-bed dryer or a shaft furnace or kiln dryer.

In one embodiment of the present invention, the drying apparatus 16 uses microwaves to effect sufficient heating of the green pellets to drive off moisture. To this end, a continuous belt microwave drying apparatus is well suited. Conventional drying apparatuses achieve drying by the passing of hot combustion gases through or above the pellets being dried i.e. heat transfer through the outer surface to the interior. In contrast, microwave drying apparatuses rely on microwave energy being directed into the volume/mass of the pellets with depth penetration being a function of the wavelength of the microwaves.

Microwave energy can be used alone or in combination with hot combustion gases to effect drying of the green pellets. The length of the drying area, the residence time in the drying apparatus 16 and the flow rate of hot gas (if used), as well as the microwave intensity are selected to ensure that the green pellets are thoroughly dried before the downstream induration stages. "Thorough drying" does not imply that 100% of any moisture is removed, but rather that the pellets are substantially moisture-free. As induration is conducted at high temperatures (300-1300° C.), the removal of substantially all moisture from the green pellets during the drying stage is important to mitigate the risk of cracking or excessive swelling of the pellets during the subsequent pre-heating and induration stages. Advantageously, during the drying process, the green pellets are effectively pre-heated above ambient temperatures in the drying apparatus 16 before entering a downstream heat treatment apparatus 20, where induration occurs. This pre-heating reduces the energy requirements of the heat treatment apparatus 20.

The dried pellets from the drying apparatus 16 are then subjected to induration in the heat treatment apparatus 20 in an oxidising atmosphere at a temperature in the range of 300-1300° C. For a given type of green pellet, the induration temperature is more important than the actual retention time at temperature in the heat treatment apparatus 20. Induration is conducted in two zones within the heat treatment apparatus 20, namely an oxidisation zone 22 and a curing zone 24. For best results, the dried pellets fed to the heat treatment apparatus 20 should be subjected to agitation, preferably tumbling, during oxidisation and curing to improve reaction kinetics and ensure more uniform exposure of the pellets to the oxidising atmosphere in the heat treatment apparatus 20 so as to provide a more complete conversion of magnetite to hematite. Suitable heat treatment apparatuses include a rotary kiln furnace, a vertical shaft furnace, a straight grate furnace, a grate kiln or a fluidised bed furnace. The time at induration ranges from 4-5 minutes for grate furnaces to up to two hours when a shaft furnace is used. A rotary kiln furnace is preferred due to increased residence times (which are readily determined based on such relevant factors as the feed rate, rotational speed, angle of kiln and energy input) thereby optimising both oxidation and curing.

Using the process of the present invention, at least a portion of the heating used to effect induration is provided using microwave energy either alone or in combination with conventional sources of heating such as natural gas or diesel/oil fired burners or heating with coal and coke alternate options. To facilitate the delivery of microwave energy into the heat treatment apparatus 20, an external microwave 30 co-operatively coupled with a waveguide 32 for controlling the distribution of the microwave energy into the heat treatment apparatus 20 is used. The external microwave 30 can equally comprise a plurality of microwave units, each unit transmitting microwave energy generated from a corresponding plurality of magnetrons and directed via one or more wave guide(s) 32 into the heat treatment apparatus 20.

Figure 1:
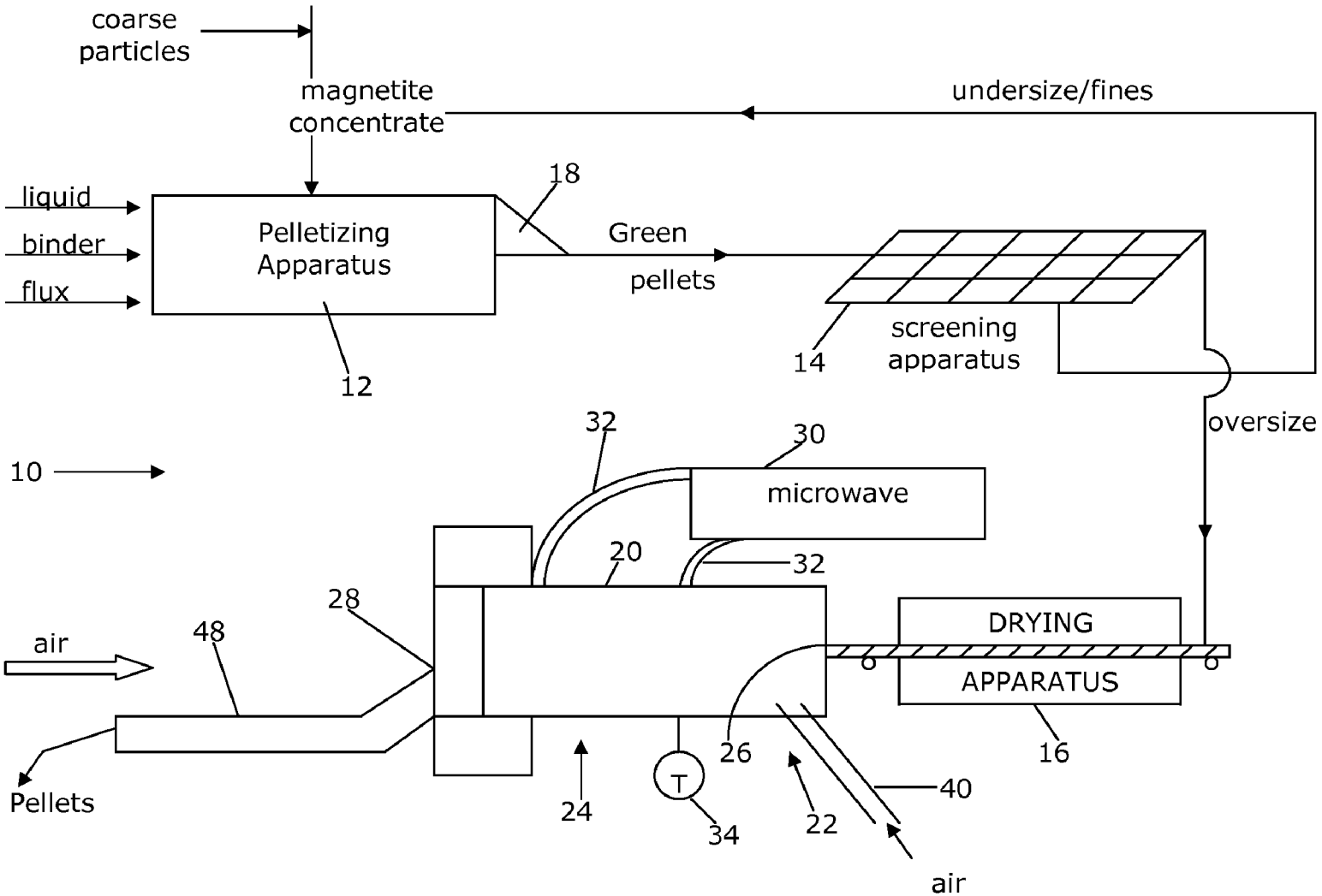
FIG. 1 is a process flow diagram illustrating a first embodiment of the present invention.

With reference to FIG. 1, the heat treatment apparatus 20 is a rotary kiln having a feed end 26 and a discharge end 28. The rotary kiln 20 is angled to encourage movement of the pellets from the feed end 26 to the discharge end 28. The oxidation zone 22 is positioned towards the feed end 26 of the rotary kiln 20. The curing zone 24 is positioned towards the discharge end 28 of the rotary kiln 20. Microwave energy from the microwave 30 is supplied into the feed end 26 or the discharge end 28 or both, via waveguides 32 arranged to direct the microwave energy where heating using microwave energy is most beneficial. In this way, the level of microwave energy supplied to the oxidation zone 22 and the curing zone 24 can be the same or can differ. A plurality of microwaves arranged at a corresponding plurality of different locations, each provided with a single waveguide can equally be used.

The heat treatment apparatus 20 is provided with a temperature sensor 34 on a feedback loop to assist in controlling the microwave energy being delivered through the wave guide 32 to the furnace 20. The rate of addition of the microwave energy to the heat treatment apparatus 20 will be a function of a number of relevant variables, including but not limited to, the volume of the heat treatment apparatus 20, the addition rate of the pellets, the moisture content of the pellets, and the energy requirements for complete oxidation and curing.

To further facilitate heating of the dried pellets using microwave energy, the inner lining of the heat treatment apparatus 20 is constructed from a material that is non-absorbent to microwaves whilst at the same time being capable of withstanding the heat of induration. Specific ceramics developed by NASA for the space shuttle that inhibit non-absorbing microwave properties are suitable as are metal alloys known in the materials science art to inhibit absorption of microwaves.

Oxidation of the magnetite present in the pellets to hematite occurs in the oxidation zone 22 of the heat treatment apparatus 20 in accordance with the following exothermic reaction:

$$4Fe_3O_4+2O_2\rightarrow 6Fe_2O_3$$

Without wishing to be bound by theory, it is understood that oxidation commences as the temperature within the oxidation zone 22 climbs above 400° C. A higher temperature increases the rate of oxidation and the degree of subsequent intergranular bridging that takes place between mineral grains in the pellets during curing. Incomplete oxidation in the oxidation zone 22 results in a non-uniform pellet composition with respect to magnetite and hematite which results in the pellets having a weakened crushing strength then is otherwise achievable when oxidation is complete.

To encourage complete oxidation occurs during induration, sufficient air/oxygen must be available in the oxidation zone 22 for substantially complete oxidation of magnetite to hematite. Oxidation can be enhanced using air enrichment via one or more lances 40 arranged to inject oxygen or air into the oxidation zone 22 of the heat treatment apparatus 20. By ensuring that there is an enhanced air/oxygen enriched environment within the oxidation zone 22 of the heat treatment apparatus 20, gas diffusion into the pellets in encouraged.

To facilitate gas diffusion within the pellets, it is highly advantageous for the pellets to be porous. In one embodiment of the present invention, the porosity of the pellets is increased by the addition of coarse particles (magnetite, hematite, silica, etc) into the magnetite concentrate feed upstream of the pelletizing apparatus 20. This is done to increase pellet internal permeability for available gases. The volume of coarse particles added can vary, with best results obtained in the range of 3%-10% coarse.

Alternatively or additionally, the porosity of the pellets can be increased through the addition of binders in excess of "normal" dosage rates. Normal dosage rates for bentonite are typically in the range of 5-15 kg/tonne. Normal dosage rates for organic binders are typically in the range of 0.3-1 kg/tonne. Best results in increasing the porosity of the pellets were achieved using excess binder additions of 3 times, 5 times and 10 times the normal dosage rates.

The heat transfer rates experienced during induration influence the final pellet quality and strength. Too rapid a preheating rate in the oxidation zone 22 can result in an inferior pellet due to sintering of the outer surface of the pellet resulting in an outer shell or semi-impermeable layer (the so-called "core and shell effect") which severely restricts oxygen diffusion into the centre of the pellets. Pellets produced in this way exhibit strong shells but weak core structures, culminating in a poor overall physical strength. In the oxidation zone, the pellets develop sufficient strength to resist breakage and crumbling which occurs as a result of the tumbling action within the curing zone.

It is also important to control the heat transfer rate to ensure that the pellets are not weakened by structural cracking. Without wishing to be bound by theory, if the green pellets are dried or heated too rapidly, excessive evaporation/displacement of moisture will increase pellet deformation i.e. cracking, splitting and rupture. Conventional pre-heating with oil or gas-fired equipment heats the pellet externally from the outer shell extending inwards. Using the heat treatment apparatus 20 of the present invention, heating/energy transfer commences from the centre of the pellet to the outside due to the inherent nature of microwaves. This reduces the risk of structural cracking.

After pre-heating in the oxidation zone 22, the pellets, at a mean temperature of 800-1000° C., are fed or pass into the curing zone 24 of the heat treatment apparatus 20. The curing zone 24 is operated within an optimum temperature range of 1200-1300° C. Without wishing to be bound by theory, solid state bonding within the pellets occurs in the curing zone due to extensive inter-granular bridging of the hematite particles. Thus particle size and size distribution within the pellet are important factors in governing the final strength of the cured pellets.

After curing, the pellets pass, in this example, by way of transport on a conveyor, from the heat treatment apparatus 20 into a cooling zone 48, through which ambient air is blown. The hot gases produced in the cooling zone 48 are recycled for use in drying the green pellets in the drying apparatus 16 or otherwise pre-heating the dried pellets being fed to the heat treatment apparatus 20. This is done to provide optimum energy utilization. After cooling, the cured pellets are stock-piled for freight removal as feed to a blast furnace or direct reduction furnace. The hard, cured pellets are of approximately 10-16 mm in diameter. The drying, induration and cooling period takes approximately 20-45 minutes depending on such relevant parameters as the composition and properties of the magnetite feed source, operating parameters and equipment selection.

Figure 3:
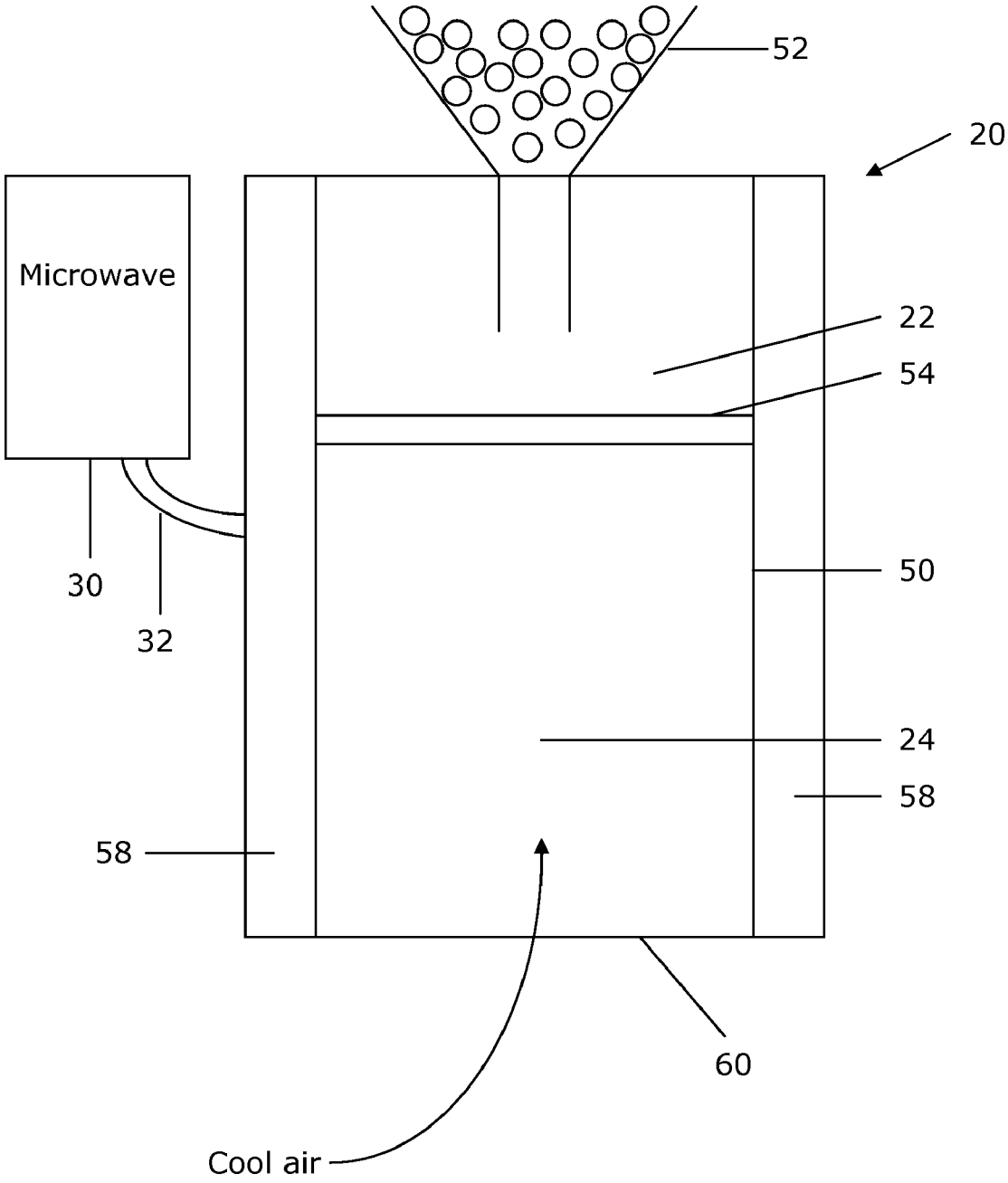
FIG. 3 is a side view of a vertical shaft microwave furnace.

In an alternative embodiment of the present invention illustrated in FIG. 3, the heat treatment apparatus 20 is a vertical shaft microwave furnace having a vertical shell 50 (round or rectangular in shape). In use, green pellets are fed through a chute 52 and placed on the top of a bed 54 within the vertical shaft microwave furnace 20. The pellets descend down through the furnace at a rate of 12-35 cm per minute. Heat is supplied to the furnace 20 from the microwave 30 via a waveguide 32 either alone or in combination with heat from combustion chambers 58 located at the outer perimeter boundaries of the vertical shaft microwave furnace 20. In this example, the oxidation zone 22 is located towards an upper portion of the vertical shaft microwave furnace 20 with the curing zone 24 being located towards a lower portion of the vertical shaft microwave furnace 20. Cool air is pumped in through the base 60 of the vertical shaft microwave furnace 20 to cool the cured pellets. The air that is pumped into the vertical shaft microwave furnace 20 picks up heat from the pellets and this hot air may be used to pre-heat the dried pellets being fed into the furnace 20 through the chute 52.

The preferred specification for the pellets produced by the various embodiments of the present invention to make a good transportable product and an excellent furnace feed include:

- approximately 68% Fe
- closely sized pellet of 6-15 mm diameter;
- fines (<1.5 mm) are rejected and should not exceed 1-2% in shipped product.
- good resistance to weathering with porosity of approximately 20-35%.
- excellent resistance to breakage during handling, shipping and freight.
- assessment for determination of resistance include drop tests, tumbler tests and compression tests.
- uniformly high grade chemical composition; slag forming oxides (silica, alumina, lime) should be maintained within 0.2% of contract specifications.
- complete oxidation of magnetite to hematite
- good reducibility in furnace
- resistance to swelling and disintegration during reduction/induration process ($CaO—SiO_2$ ratio very important).

To facilitate a better understanding of the processes of the present invention, the following non-limiting examples are provided. It is expected that a person skilled in the art may devise other methods without departing from the inventive concept of the present invention. All such variations are considered to be within the scope of the present invention for which the following examples are for illustrative purpose only. Testing of pellet strength at the end of the process is carried out using a compression test unit, typically an Instron® (registered trade mark of Instron Corporation) compression unit having a load capacity of 10 kN or greater, using flat, parallel compressive platens and a speed setting of 10 mm/min-20 mm/min. After curing, the pellets strength must be a minimum of 1780N (178 $kg_f$) to meet acceptable average, world recognised pellet specifications which are in the range 200-300 $kg_f$.

EXAMPLE 1

Batch Testing

A laboratory sized 1 meter diameter pelletizing disc was used for the production of green pellets. The pelletizing disc was operated at approximately 30 rpm at a disc angle of 45 degrees to the horizontal. Green pellets were produced with varying binder types, namely bentonite and an organic binder produced by Lamberti under the proprietary name Carbocel. The organic binder was preferred as the silica content of the bentonite (29-52%) was considered to be too high as it marginally increases the overall pellet $SiO_2$ content and subsequently reduces iron grade. An additional advantage of using an organic binder is its ability to reduce during the heating a curing process, thereby producing a more porous pellet suitable for DRI or blast furnace applications as well as assisting in oxidation within the microwave process.

The green pellets were screened for fines removal and sized by hand (>15 mm pellets returned as feed material). Selected pellets were subjected to drop tests with the average number of drops before pellet fracture averaging an acceptable 2 to 4 drops.

Batch microwave tests were conducted on "green" magnetite pellets using a 2.45 GHz variable input 1.3 kW microwave oven operating off a conventional 220V/15 A supply. Tests were conducted utilizing 5-8 pellets at a time and varying the following parameters:

- Temperature variations
- Microwave heating duration
- Air injection (lance)
- Magnetite grades and sizing
- Binder addition rates and type
- Comparison of muffle furnace versus microwave heating apparatus For batch testing purposes, four different commercial grade magnetite concentrates were tested in conjunction with two binders. The properties of the magnetite concentrates are listed in Table 1 below:

TABLE 1

| Sample | Sample Number | $Fe_3O_4$ % | $Fe_2O_3$ % | FeO % | $Si_2$ % | $Al_2O_3$ % | Fe % |
|---|---|---|---|---|---|---|---|
| | | Magnetite | | | | | |
| Pellet A | 9818/0213 | | 81.6 | 10.9 | | | |
| Pellet B | 9818/0212 | | 92.2 | 1.28 | | | |
| Unimim-MEDIUM | 98180215 | 91.9 | | | 4.41 | 0.89 | 66.51 |
| Unimin-FINE | 98180214 | 92.20 | | | 4.21 | 0.92 | 66.72 |
| Unimin-Superfine | | 93.31 | | | 3.46 | | 67.52 |
| Tasmania Mines-FINE | 9818/0216 | 94.3 | | | 1.94 | 0.4 | 68.2 |

Pellet strength was determined using an Instron compression test unit. The strength of the pellets increased with the addition of supplementary air into the furnace using a lance. Strength was also increased by the addition of excess Carbocel binder (10 times the normal addition of 0.04 kg/tonne) which resulted in a more porous pellet through which oxygen diffusion takes place.

Slow to moderate drying temperatures were beneficial in reducing the "onion" effect of inner core and outer layering which was more pronounced in the pellets that were rapidly dried or pre-heated. The duration of time at which the pellet is subjected to high microwave energy was an important factor governing the final strength of the pellets. An average time of 5-10 minutes was found to be provide sufficient final strength.

Compression test results varied considerably from 0.4-3.5 kN depending on a number of different variables as outlined in Table 2 below:

TABLE 2

| Energy source | Magnetite/Binder | Test details | Compression strength range [kN] |
|---|---|---|---|
| 2.45 GHz microwave | UM Superfines + bentonite | Rapid dry & heat with ~5-10 minutes @ 1200° C. | 0.4-4.1 |
| 2.45 GHz microwave | UM Superfines + bentonite | Moderate dry & preheat - 2 minutes @ 1000° C. followed by 3 minutes @ 1200° C. (Air addition with lance) | 0.8-4.1 (average 1.86) |
| 2.45 GHz microwave | UM Medium & TM Fines (mixture of bentonite & Carbocel) | 5 minutes @ 1000° C. & 10 minutes @ 1200° C. | 0.5-2.25 |
| 2.45 GHz microwave | UM Fines + Carbocel | Slow dry & preheat & 10 minutes @ 1000° C. | Average 1.72 |
| Muffle furnace | TM Fines + Carbocel TM Fines + Bentonite | 2 hrs to 950° C. & held for 15 minutes/1 hr to 1200° C. & held for 20 minutes | Average 5.5 |
| 2.45 GHz microwave | TM Fines + excess Carbocel (10 times) | Slow dry & heat followed by 5 minutes @ 1000° C. & 5 minutes @ 1200° C. | Average 2.8 |

From Table 2, it was concluded that required compression strengths of >2 kN are favoured using a combination of a number of the following factors:

Slow drying and pre-heating stages

Prolonged time at temperature within microwave field i.e. 5-10 minutes at required temperatures Air injection within furnace cavity by means of air lance Addition of excess Carbocel binder to produce a more porous pellet and therefore enhanced conversion of magnetite to hematite

EXAMPLE 2

Continuous Testing

A rotary kiln was used for continuous testing using a 100 mm internal rotating kiln tube approximately 1.5 meter long with variable speed drive and 6 internal 8 mm×8 mm lifters. The kiln tube was constructed of stainless steel/nickel alloy to withstand the high temperatures (~1150° C.) with external cladding for heat recovery. The rotary kiln had an adjustable kiln angle with microwave chokes incorporated on both feed and discharge ends to limit microwave radiation. The feed and discharge ends of the kiln were supported and guided using an external bearing arrangement. Microwave power was supplied to the furnace using a 5 kW 2.45 GHz microwave generator with the microwaves being introduced into the kiln via aluminium waveguides (62 mm wide×30 mm high). The waveguides were arranged to allow the option of introducing microwaves into the kiln from either feed or discharge ends or both. The kiln was further fitted with a variable speed vibratory feeder for pellet feed through a silica glass tube into the furnace. The tests were conducted at a nominal kiln speed of approximately 3 rpm.

Green pellets were firstly batch dried in a microwave and placed in the vibratory feeder. Feed together with kiln rotation commenced so as to place a "load" within the kiln into which the microwave energy can be absorbed. Microwave energy was then introduced with input power adjusted to approximately 2 kW. Very rapid internal heating of the pellets was evident with a rapidly forming hot zone. On heating this hot zone, plasma formation commenced (plasma formation caused primarily by a high electrical field). Plasma formation should be avoided as this reduces the microwave energy available for heating and could result in potential damage to the microwave generator. It was noted that the majority of the plasmas were forming due to very fine dust/fines entering the silica tube and coming into contact with the microwaves directly in the middle of the waveguide.

Plasma formation was mitigated by reducing the fines in the feed, by applying microwave energy in continuous ON/OFF cycles, by increasing the volume of the furnace cavity or by increasing the load of the feed in the furnace. A larger diameter kiln reduce the effects of plasma formation as well as assists in improved utilization of microwave energy into specific areas within the kiln thereby providing the flexibility of adjusting the size of both the oxidation an curing zones. Insertion of waveguides into kiln tube (both feed and discharge ends) enhance and strategically target microwave energy input. It is also advantageous for plasma protection devices (such as quartz windows) to be fitted to waveguides for magnetron protection.

The tests continued by rotating the kiln together with the addition of microwaves at 4.5 kW. Heating of the pellets was evident as some of the pellets were glowing red. This was at first thought to be problematic in that the pellets appeared to be heating up unevenly but in a longer continuous run this was overcome once the kiln itself reached operating temperature, at which time the heat transfer between pellets and kiln shell equalized. As soon as the bed reached a visually hot, glowing red colour, plasma formation commenced with the immediate negative affect of minimizing available power input.

The test results from Examples 1 and 2 above demonstrated that pellets formed from magnetite concentrates readily absorb microwave energy and heat rapidly via an exothermic reaction induced by the presence of oxygen which promotes the conversion of magnetite to hematite (oxidation reaction) under thermal conditions. Following numerous batch trials, crushing tests were conducted on microwave cured magnetite pellets utilizing the International Standard procedures as outlined in ISO 4700 "Iron Ore Pellets—Determination of crushing strength". The pellets tested had compression results of >2 kN per pellet which is recognized as the world acceptable specification benchmark for export quality pellets.

Now that the preferred embodiments of the present invention have been described in detail, the present invention has a number of advantages over the prior art, including the following:

a) replacement of conventional gas/oil fired applications for curing of iron pellets by microwave technology resulting in small, modular, compact production units combined with improved quality & operational control and reduced gas emissions; and, b) the gains of heat recovery and usage thereof has the potential to reduce overall power consumption to <20 kWh/tonne feed in grate kiln systems and <35 kWh/tonne for straight grate systems and this should again be further reduced by utilizing microwave technology.

It will be apparent to persons skilled in the relevant art that numerous variations and modifications can be made without departing from the basic inventive concepts. For example, a substantially horizontal straight grate microwave furnace may be used with a continuously moving grate onto which a bed of green pellets are deposited. In this example, the grate passes through the oxidation zone which uses microwave energy to heat the pellets either alone or in combination with the heat generated from hot gases being pumped through the pellet beds. The oxidised pellets then pass into the curing zone. After curing, the pellets are cooled. Similarly, a grate/kiln furnace may be used which comprises a continuously moving grate followed by a rotary kiln arrangement. The cured pellets are cooled in a separate annular cooler with the hot gases transferred to the drying/pre-heating stage for waste heat utilization. Use of a rotary kiln is advantageous in that this provides continuous mixing at a substantially uniform temperature resulting in high quality pellets. All such modifications and variations are considered to be within the scope of the present invention, the nature of which is to be determined from the foregoing description and the appended claims.

It will be clearly understood that, although one or more prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A method for producing hematite iron ore pellets by exposing green pellets containing magnetite to microwave energy in a heat treatment apparatus under oxidizing conditions to convert the magnetite to hematite, wherein microwave energy is supplied to an oxidation zone via a first waveguide and microwave energy is supplied to a curing zone via a second waveguide and the level of microwave energy supplied to the curing zone is different from the level of microwave energy supplied to the oxidation zone.

2. The method of claim 1 wherein the green pellets contain at least 60 to 80% magnetite prior to exposure of the green pellets to microwave energy.

3. The method of claim 1 wherein the green pellets have a major dimension of less than 15 mm prior to exposure of the green pellets to microwave energy.

4. The method of claim 1 wherein the green pellets have a major dimension greater than 6 mm and less than 15 mm prior to exposure of the green pellets to microwave energy.

5. The method of claim 1 further comprising the step of screening the green pellets prior to exposing the green pellets to microwave energy to remove fines.

6. The method of claim 5 wherein the fines removed during the step of screening are recycled to form a portion of a magnetite concentrate fed to a pelletizing apparatus.

7. The method of claim 1 further comprising the step of transporting the green pellets to an inlet end of the heat treatment apparatus on a conveyer and transporting the pellets from an outlet end of the heat treatment apparatus on a conveyer.

8. The method of claim 1 wherein the green pellets are produced in a pelletizing apparatus, the feed to the pelletizing apparatus comprising a liquid and a magnetite concentrate.

9. The method of claim 1 wherein more than 50% of the particles in a magnetite concentrate fed to a pelletizing apparatus are less than 63 microns in size.

10. The method of claim 1 wherein a binder is added to a feed to a pelletizing apparatus to form the green pellets, and the binder is added to the feed at a dosage rate of 0.3-15kg per tonne.

11. The method of claim 1 further comprising the step of drying the green pellets prior to the step of exposing the green pellets to microwave energy in the heat treatment apparatus.

12. The method of claim 11 wherein the step of drying includes heating the green pellets to a temperature less than 300° C. using microwave energy to drive off moisture.

13. The method of claim 12 wherein microwave energy is used to heat the green pellets in the heat treatment apparatus to a temperature in the range of 300-1300° C.

14. The method of claim 1 wherein the heat treatment apparatus includes a microwave co-operatively coupled with a waveguide for controlling the distribution of the microwaves into the heat treatment apparatus.

15. The method of claim 14 wherein the heat treatment apparatus has a feed end and a discharge end and the method includes the step of supplying microwave energy into either the feed end or the discharge end of the heat treatment apparatus via waveguides.

16. The method of claim 14 wherein the heat treatment apparatus has a feed end and a discharge end and the method includes the step of supplying microwave energy into both the feed end and the discharge end of the heat treatment apparatus via waveguides.

17. The method of claim 1, further comprising the step of enhancing oxidation within the oxidation zone of the heat treatment apparatus using air or oxygen enrichment.

18. The method of claim 17 wherein oxidation is enhanced by the addition of supplementary air into the heat treatment apparatus using a lance.

19. The method of claim 1 wherein the green pellets are porous.

20. The method of claim 1 further comprising the step of adding coarse particles into a magnetite concentrate feed upstream of a pelletizing apparatus.

21. The method of claim 1 wherein a magnetite concentrate feed comprises coarse particles in the range of 3 to 10% of the total magnetite concentrate feed.

22. The method of claim 1, further comprising the step of curing the pellets after oxidation of the magnetite to hematite.

23. The method of claim 22 wherein the step of curing is conducted at a temperature in the range of 1200-1300° C.

24. The method of claim 1 further comprising the step of cooling the pellets downstream of the heat treatment apparatus and using the hot gases produced as a result of cooling the pellets to pre-heat or dry the green pellets upstream of the heat treatment apparatus.

* * * * *